United States Patent [19]

Tsunekawa et al.

[11] Patent Number: 4,882,520

[45] Date of Patent: Nov. 21, 1989

[54] RARE GAS ARC LAMP HAVING HOT CATHODE

[75] Inventors: Shinichi Tsunekawa, Fujisawa; Masami Takagi, Yokohama, both of Japan

[73] Assignee: Kabushiki Kaisha Toshiba, Kawasaki, Japan

[21] Appl. No.: 176,147

[22] Filed: Mar. 31, 1988

[30] Foreign Application Priority Data

Apr. 2, 1987 [JP] Japan ..... 62-79719

[51] Int. Cl.[4] ..... H01J 17/20; H01J 61/16

[52] U.S. Cl. ..... 313/643; 313/485; 313/488; 313/489; 313/572; 313/576

[58] Field of Search ..... 313/643, 576, 488, 489, 313/484, 572, 485

[56] References Cited

U.S. PATENT DOCUMENTS

| | | | |
|---|---|---|---|
| 2,622,221 | 12/1952 | Beese | 313/485 X |
| 3,275,872 | 9/1966 | Chernin et al. | 313/488 |
| 4,298,822 | 11/1981 | Fukuda | 313/493 |
| 4,461,981 | 7/1984 | Saikatsu et al. | 313/643 X |

FOREIGN PATENT DOCUMENTS

| | | | |
|---|---|---|---|
| 0121261 | 9/1980 | Japan | 313/489 |
| 0084763 | 5/1985 | Japan | 313/489 |

OTHER PUBLICATIONS

Toshiba Review vol. No. 12, Published Nov. 1985, Author: Yoshiji Yoshiike.

*Primary Examiner*—Donald J. Yusko
*Assistant Examiner*—Michael Horabik
*Attorney, Agent, or Firm*—Cushman, Darby & Cushman

[57] ABSTRACT

A rare-gas arc lamp includes a pair of coil filaments disposed at the opposite ends of an elongated bulb for increasing an area of a positive column produced between the coil filament pair in a direction perpendicular to the elongated axis of the bulb, and a rare-gas mainly including xenon gas and having substantially no mercury therein sealed in the bulb at a prescribed pressure selected from the range between 20 Torr and 200 Torr. The combination of the coil filament pair and the xenon gas sealed in the bulb at a prescribed pressure in the range of 20 Torr to 200 Torr may reduce visible changes in a luminance distribution of the lamp when the positive column fluctuates during the operation of the lamp.

12 Claims, 2 Drawing Sheets

RARE GAS ARC LAMP HAVING HOT CATHODE

BACKGROUND OF THE INVENTION

1. Field of the Invention

This invention relate, in general, to rare-gas arc lamps wherein a rare gas, e.g., argon or xenon, is sealed. The rare-gas arc lamp produces a positive column between a pair of electrodes for radiating light.

2. Description of the Prior Art

A xenon glow lamp and a fluorescent lamp are used for a light source of an apparatus, such as, e.g., copying machine, facsimile device, etc. The xenon glow lamp and the fluorescent lamp also are used for a backlighting of a liquid crystal display. As is well known, in a typical fluorescent lamp, a pair of coil filaments are respectively arranged at opposite ends of an elongated bulb, the inner surface of which is coated with a fluorescent material. A fill including mercury and a rare-gas, e.g., argon is sealed in the bulb. In such a lamp, the amount of ultraviolet rays produced is closely related to temperature. This is because the vapor pressure of mercury depends upon the ambient temperature, and the amount of ultraviolet rays is a function of the vapor pressure of mercury within the bulb. Therefore, the luminous efficiency of the lamp extremely decreases when the ambient temperature decreases under 5° C. or increases above 60° C. In an extremely low temperature atmosphere, the starting ability of the lamp greatly decreases, and thus, the starting voltage of the lamp becomes high. Furthermore, since a fluorescent lamp uses the Penning effect of argon gas, argon gas is sealed in the bulb at a prescribed low pressure less than 5 Torr. A Faraday dark space exists in front of an electrode (cathode) because of the low sealing pressure of argon gas. Such a dark space extends approximately 10 mm in the lamp. Since this dark space does not contribute to the radiation, the effective luminescence length of the lamp relatively decreases.

Since the fluorescent lamp includes a pair of hot cathode type electrodes composed of a coil filament, as described above, an electron emissive material, e.g., barium oxide, applied to the coil filament easily evaporates and is adhered onto the inner surface of the bulb when the temperature of the coil filament increases above a prescribed value during operating. Therefore, the inner surface of the bulb becomes black by the accumulation of the electron emissive material.

The xenon glow lamp does not have such disadvantages described above. A conventional xenon glow lamp typically includes a pair of cold cathode type electrodes respectively disposed at opposite ends of a bulb. A rare-gas mainly including xenon gas is sealed in the bulb. A fluorescent layer is formed on the inner surface of the bulb. In such a xenon glow lamp, since the rare-gas is sealed in the bulb at a relatively high pressure greater than 50 Torr, the xenon glow lamp has less temperature dependency compared with the fluorescent lamp described above. However, the starting voltage of the xenon glow lamp is high because of the high sealing pressure. Furthermore, a lamp current is limited to a relatively low value due to the cold cathode type electrode. If the lamp current increases, the cold cathode would evaporate when operating. In such a xenon glow lamp, the positive column existing between the cold cathode electrodes is small in diameter due to the small amount of the lamp current. A desirable luminance distribution can not be achieved. This is because such a thin positive column fluctuates during the operation. The fluctuation of the positive column varies from time to time, and therefore, the luminance distribution is not stable.

SUMMARY OF THE INVENTION

Accordingly, it is an object of the present invention to control the luminance distribution of a rare-gas arc lamp which varies when a positive column fluctuates during the operation.

It is another object of the invention to provide an improved rare-gas arc lamp which is less dependent upon atmospheric temperature.

To accomplish the above-described objects, a rare-gas arc lamp includes a tube for transmitting light, a rare-gas mainly including xenon gas and having substantially no mercury therein and sealed in the tube at a prescribed sealing pressure, a first electrode at a first position within the tube, a second electrode constituted by a hot cathode at a second position within the tube, and a device for providing a potential difference between the first and second electrodes so as to establish a positive column therebetween, the positive column having an area perpendicular to the axis of the tube that is larger than the corresponding area of arc discharge lamps not using a hot cathode for controlling luminance distribution that would otherwise vary in a cold cathode device. The sealed pressure of the rare-gas may be selected from the range between 20 Torr and 200 Torr.

BRIEF DESCRIPTION OF THE DRAWINGS

These and other objects and advantages of this invention will become apparent from the following detailed description of the presently preferred embodiment of the invention, taken in conjunction with the accompanying drawings of which.

DETAILED DESCRIPTION OF THE PREFERRED EMBODIMENTS

Figure 1:
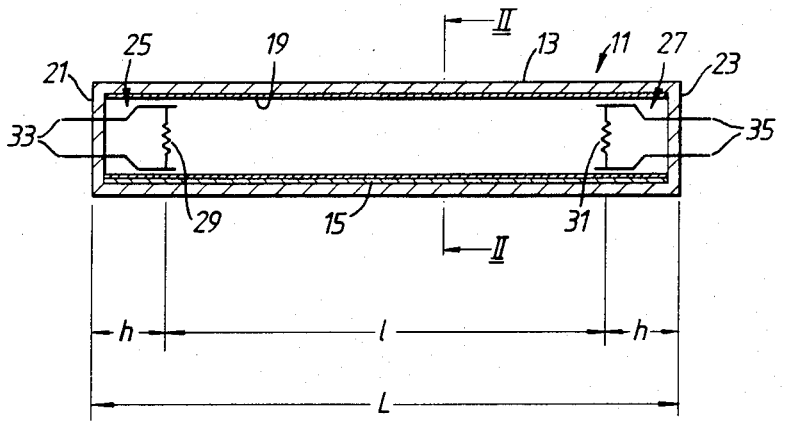
FIG. 1 is a cross sectional plan view illustrating an aperture type rare gas arc lamp of one embodiment of the present invention.
Figure 2:
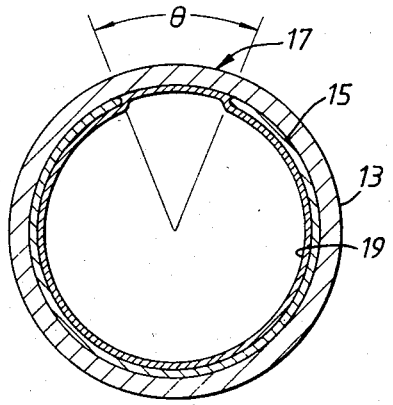
FIG. 2 is a cross sectional view taken on line II—II of FIG. 1.

The preferred embodiment of the present invention will now be described in more detail with reference to the accompanying drawings. FIGS. 1 and 2 show an aperture type rare-gas arc lamp of one embodiment of the present invention. A rare gas arc lamp 11 includes an elongated bulb 13 made of quartz glass. Elongated bulb 13 may also be made of hard glass or soft glass. The inner diameter of bulb 13 is selected from the range between 6 mm and 12 mm to be used as a light source of an apparatus, such as, e.g., facsimile device, copying machine, etc. A light impermeable layer 15, e.g., reflection layer, is formed on the inner surface of bulb 13 except a light permeable portion 17 extending along the elongated axis of bulb 13. As shown in FIG. 2, light permeable portion 17 extends in a peripheral direction by a prescribed angle $\theta$ from the center of bulb 13. A fluorescent layer 19 is formed on surfaces of light impermeable layer 15 and light permeable portion 17 of bulb 13. Therefore, light is radiated from light permeable portion 17 of bulb 13. A pair of button stems 21, 23 are individually attached to the opposite ends of bulb 13 in an airtight state. A pair of electrodes 25, 27 are respectively supported by the corresponding stems 21, 23. Each electrode 25, 27 includes a hot cathode 29, 31, i.e., coil filament, and a lead wire 33, 35 for supporting hot cathode 29, 31. Each lead wire 33, 35 penetrates the corresponding stems 21, 23 in an airtight state. An electron emissive material is applied to each hot cathode.

In the above-described construction, a rare-gas including xenon gas is sealed in bulb 13 at a prescribed pressure selected from the range between 20 Torr and 200 Torr to avoid the evaporation of the electron emissive material applied on the hot cathodes 29 and 31. If the sealing pressure of the rare-gas is low, the electron emissive material easily evaporates when the temperature of each hot cathode 29, 31 increases over a prescribed value. If the sealing pressure of the rare-gas is less than 20 Torr, the positive column does not concentrate, and the boundary of the positive column is gradated. If the sealing pressure of the rare-gas is greater than 200 Torr, the voltage applied to the lamp extremely increases, and thus, a costly insulation to the lamp is required. Therefore, it is not suitable for a practical use.

The operation of the above-described aperture type rare-gas arc lamp will now be described.

When a prescribed voltage is supplied between hot cathodes 29 and 31, hot cathodes 29 and 31 are preheated, and thus, respectively radiate thermoelectrons. Accordingly, an arc discharge occurs between hot cathodes 29 and 31 when a starting voltage is applied between hot cathodes 29 and 31 by a conventional glow switch starter (not shown). The rare-gas in bulb 13 radiates ultraviolet rays by the arc discharge, and the resonant rays of the ultraviolet rays excite fluorescent layer 19 formed on the inner surface of bulb 13, resulting in the radiation of visible rays.

The visible rays are radiated toward the outside of bulb 13 through light permeable portion 17 of bulb 13. Since light permeable portion 17 allows the visible rays transmitting bulb 13 to have a directivity, the visible rays are radiated in one direction defined by light permeable portion 17.

In the above-described rare-gas arc lamp, since mercury is not sealed in bulb 13, the pressure in bulb 13 is seldom influenced by the temperature in an atmosphere. Therefore, the light efficiency and the starting ability of the rare-gas arc lamp are stable, and changes in a quantity of arc caused by changes of the peripheral temperature decreases.

In particular, since a hot cathode comprising a coil filament is used as an electrode in the above-described embodiment, the starting voltage of the lamp reduces, and the lamp easily operates. This is because the hot cathode is pre-heated, and radiates thermoelectrons therefrom when operating. Furthermore, since xenon gas has a high heat conductivity compared with argon gas, the heat generated by the hot cathode is easily radiated from the surface of bulb 13 through xenon gas. As a result, increase in temperature of the hot cathode is controlled, and thus, evaporation of the hot cathode, i.e., coil filament, may be avoided. The lamp current can also be increased because of the high heat conductivity of xenon gas. An area of the positive column in the direction perpendicular to the elongated axis of bulb 13 increases because of the increases of the lamp current. Therefore, undesirable luminance distribution is not observed visually even though the positive column fluctuates during the operation. Since the rare-gas including xenon gas is sealed in bulb at a prescribed high pressure, the evaporation of the hot cathode is avoided, and thus, accumulation of the evaporated hot cathode onto the inner surface of bulb 13 does not occur. Furthermore, a length of the Faraday dark space decreases to several mm because of a high sealed gas pressure in bulb 13, and therefore, the effective luminous length of bulb 13 increases.

In this embodiment, since button stem 21, 23 is used as an electrode mount, the height h of electrode 25, 27 from the end portion of bulb 13 reduces. Therefore, the effective luminous length l against the entire length L of bulb 13 may increase. On the contrary, the entire length L of bulb 13 may reduce if the effective luminous length l is the same as that of the conventional lamp, resulting in a small lamp. The above-described advantage of this embodiment is further promoted by decrease of the Faraday dark space described above.

Figure 3:
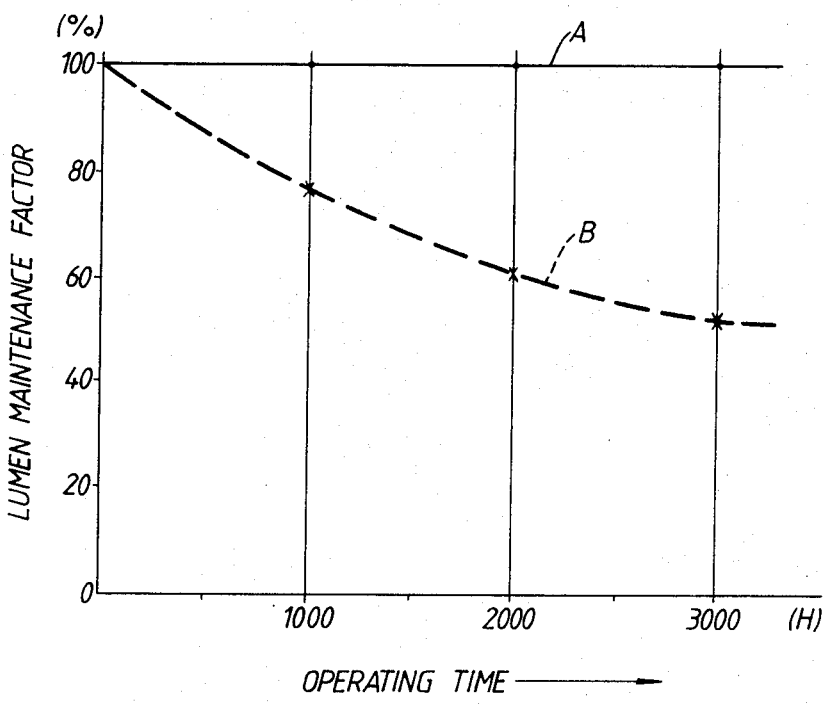
FIG. 3 is a graph showing each transition of the lumen maintenance factors of one embodiment shown in FIG. 1 and a conventional lamp when the lighting time elapses.

FIG. 3 shows each lumen maintenance factor of the aperture type xenon arc lamp of the present invention and the conventional aperture type fluorescent lamp for comparison. The aperture type xenon arc lamp has an outer diameter of 10 mm, and a bulb length of 200 mm. The xenon arc lamp also has a pair of coil filaments, as a hot cathode. Xenon gas is sealed at 80 Torr in the arc lamp of the present invention. The transition of the lumen maintenance factor of this xenon arc lamp is indicated by a solid line A. The conventional aperture type fluorescent lamp has an outer diameter of 10 mm, and a bulb length of 200 mm. The fluorescent lamp also has a pair of coil filaments, as a hot cathode. Argon gas is sealed at 3 Torr in this fluorescent lamp. A small quantity of mercury also is sealed in this fluorescent lamp. The transition of the lumen maintenance factor of this fluorescent lamp is indicated by a dotted line B.

As can be seen in FIG. 3, the lumen maintenance factor of the fluorescent lamp decreases under 60% after three thousand hours operation because of the accumulation of the electron emissive material to the inner surface of the bulb. However, the lumen maintenance factor of the xenon arc lamp (one embodiment) is maintained at substantially 100% after three thousand hours operation. The accumulation of the electron emissive material to the inner surface of the bulb was not observed visually.

The present invention is not restricted to the above-described embodiment. A belt-shaped outer electrode which has an uniform width may be formed, as a starting aid electrode, on the outer surface of the bulb along the elongated axis of the bulb. The starting ability may be enhanced when the voltage is applied to the outer electrode when operating. The outer electrode comprises an electroconductive layer including copper and carbon. The mixture of a copper powder and a carbon powder is impasted and is applied to the outer surface of the bulb. The mixture on the bulb is baked after drying. In the above-described embodiment, the present invention is applied to the aperture type rare gas arc lamp. However, the present invention may be applied to other lamps which have no reflection layer or no light impermeable layer. The above-described rare-gas mainly includes xenon gas in one embodiment. However, the rare-gas may include another kind of rare-gas selected from krypton, argon, neon, and helium, together with xenon gas.

Figure 4:
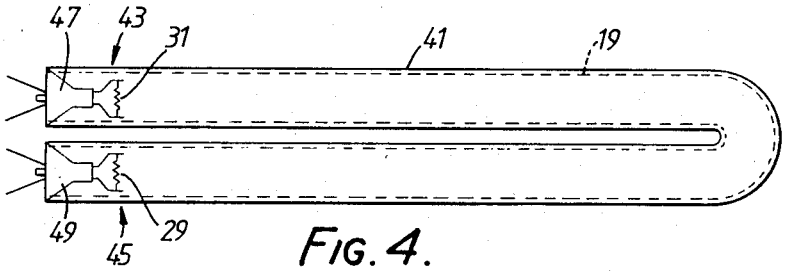
FIG. 4 is a schematic plan view illustrating a second embodiment of the present invention.

As shown in FIG. 4, the present invention may be applied to a U-shaped bulb 41. A pair of hot cathodes 43, 45 are respectively supported by a pair of flare stems 47, 49 which are disposed at both ends of bulb 41 respectively. The present invention may also be applied to other shaped bulb, e.g., W-shaped bulb.

With the above-described embodiment, since the rare-gas mainly including xenon gas is sealed in the bulb at a prescribed pressure between 20 and 200 Torr, the pressure in the bulb is seldom influenced by the peripheral temperature. The boundary of the positive column is visually distinguished because of a high pressure. Furthermore, since a relatively large amount of lamp current is applied to the hot cathode, the area of the positive column in the direction perpendicular to the elongated axis of the bulb increases. Therefore, the luminance distribution may be stable even though the fluctuation of the positive column occurs.

The present invention has been described with respect to specific embodiments. However, other embodiments based on the principles of the present invention should be obvious to those of ordinary skill in the art. Such embodiments are intended to be covered by the claims.

What is claimed is:

1. A rare-gas arc lamp which produces a positive column for radiating light in a predetermined luminance distribution, said rare-gas arc lamp comprising:

a tube having an axis;

a fluorescent layer formed on the inner surface of said tube;

a rare-gas mainly including xenon gas and having substantially no mercury sealed within said tube, said rare-gas being sealed within said tube at a pressure in the range of 20 Torr to 200 Torr;

a first electrode located at a first position within said tube;

a second electrode, constituted by a hot cathode, at a second position within said tube; and means for providing a potential difference between the first and second electrodes so as to establish a positive column therebetween, said positive column having an area perpendicular to said axis, said area being larger than a corresponding area of an arc discharge lamp not using a hot cathode for controlling luminance distribution.

2. A lamp according to claim 1 further comprising a reflection layer disposed between the inner surface of the tube and the fluorescent layer except over a prescribed area of the inner surface of the tube for radiating light in a predetermined direction through the prescribed area.

3. A lamp according to claim 1, wherein the hot cathode includes coil filament and an electron emissive material coated on the coil filament.

4. A lamp according to claim 1, wherein the first electrode is constituted by a hot cathode so that the tube has two hot cathodes therein.

5. A lamp according to claim 4, wherein the first electrode includes a coil filament and an electron emissive material coated on the coil filament.

6. A lamp according to claim 5 further comprising a reflection layer disposed between the inner surface of the tube and the fluorescent layer except over a prescribed area of the inner surface of the tube for radiating light in a predetermined direction through the prescribed area.

7. A lamp according to claim 4 further including a pair of plate-shaped stems for respectively supporting the hot cathode electrodes, respectively.

8. A lamp according to claim 4 further including a pair of flare-shaped stems for respectively supporting the hot cathode electrodes.

9. A lamp according to claim 1, wherein the tube has a generally elongate shape.

10. A lamp according to claim 1, wherein the tube has a generally U-shape.

11. A lamp according to claim 4, wherein the tube has a generally elongate shape.

12. A lamp according to claim 4, wherein the tube has a generally U-shape.

* * * * *